United States Patent [19]

Johnston

[11] Patent Number: 4,473,806

[45] Date of Patent: Sep. 25, 1984

[54] REVERSIBLE ELECTRODEPOSITION SWITCHING DEVICE

[76] Inventor: Edward J. Johnston, 1875 Braeburn Rd., Altadena, Calif. 91001

[21] Appl. No.: 344,386

[22] Filed: Feb. 1, 1982

[51] Int. Cl.[3] ..... H01P 1/10; H01P 1/22; H01P 1/00

[52] U.S. Cl. ..... 333/101; 333/81 B; 333/262; 333/263; 361/281; 336/225; 204/DIG. 6

[58] Field of Search ..... 333/101, 258, 262, 81 B, 333/263, 253; 200/61.04; 204/14 R, 3, 38, 193, 194, 228, DIG. 6; 361/278, 280, 281; 336/200, 225

[56] References Cited

U.S. PATENT DOCUMENTS 3,461,044 8/1969 Lyons et al. ..... 204/3

3,466,586 9/1969 Bull et al. ..... 336/225

4,179,627 12/1979 Reitz ..... 361/281 X

OTHER PUBLICATIONS

Camlibel et al., "An Experimental Display Structure Based on Reversible Electrodeposition", *Applied Physics Letter,* vol. 33, No. 9, (Nov. 1, 1978), pp. 793–794.

*Primary Examiner*—Paul L. Gensler
*Assistant Examiner*—Benny Lee
*Attorney, Agent, or Firm*—Christie, Parker & Hale

[57] ABSTRACT

A cell changes conductivity by electrodeposition of a metal in response to an applied voltage pulse. The cell can be used as a variable resistance device to provide a broad frequency switching or modulating device that operates to switch dc as well as microwave energy. The cell also functions as a variable reactance device.

11 Claims, 7 Drawing Figures

REVERSIBLE ELECTRODEPOSITION SWITCHING DEVICE

FIELD OF THE INVENTION

This invention relates to voltage responsive switching devices, and more particularly, is concerned with a switching device which uses an electrodeposition process to produce a variable impedance or reactance.

BACKGROUND OF THE INVENTION

Electrolytic cells have been used as optical devices. These cells provide a pair of electrodes in the form of a molecular metallic layer on a dielectric substrate, the electrodes being separated by an electrolyte containing metallic ions such as silver. An electrical pulse applied across the electrodes causes the silver ions to plate out on one of the electrodes, changing the opacity of the electrode surface. The plating process can be made reversible by reversing the polarity of an applied voltage pulse. Such an optical device is described, for example, in the article "An Experimental Display Structure Based on Reversible Electrodeposition" by Camlibel, Singh, Stocker, Van Uitert, and Zydzik, *Applied Physics,* Letter 33(9), Nov. 1, 1978. Such cells have heretofore been of interest because of their optical properties. Such cells operate by electrodepositing an opaque layer of metal out of a transparent electrolyte. The process can be made reversible by changing the polarity of the voltage across the cell, resulting in a device which can be switched between an optically transparent and an optically opaque condition. Applicant has found that the electrodeposition of metal ions from an electrolyte can also be used to change the electrical resistivity of cell electrodes, giving rise to a device which can be used as an electrical switching device over a wide frequency band including dc.

In brief, the present invention provides a cell having two electrode surfaces separated by an electrolyte. By applying an electrical pulse across the electrodes, metal ions are plated out on one or the other of the electrodes to sufficient thickness to reduce the electrical resistivity of the electrode surface from a relatively high value to a very low value. Thus the device can be used to change the electrical resistivity of a current path between two terminals embedded in one or both the electrodes. A reverse polarity pulse returns the device to its original state.

The electrical resistance may be varied over a wide range of values. As a nonmechanical electro-chemical switch, it is capable of almost limitless cycles of operation without failure.

DESCRIPTION OF THE DRAWINGS

For a more complete understanding of the invention, reference should be made to the accompanying drawings, wherein.

DETAILED DESCRIPTION

Figure 1:
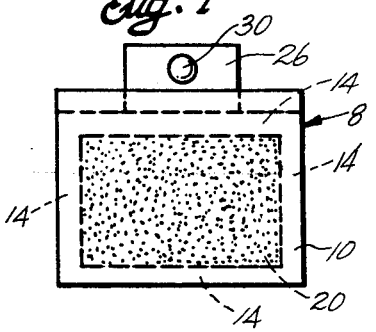
FIG. 1 is a plan view of a reversible electrodeposition cell.
Figure 2:
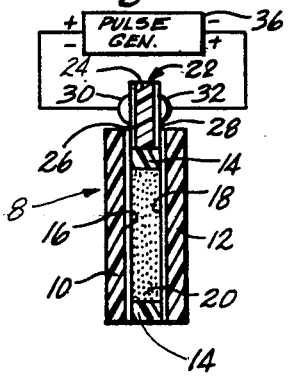
FIG. 2 is a cross-sectional view of the electrodeposition cell.

A suitable electrical cell 8 is shown in detail in FIGS. 1 and 2. The cell consists of a pair of dielectric substrates 10 and 12 which are held in spaced relationship by a sealing gasket 14 extending around the perimeter of the substrates. Each substrate has a metallic electrode, indicated at 16 and 18 respectively, which is formed by vacuum depositing a molecular layer of metal, such as $TiO_2$, for example. The metallic electrode may be very thin, of the order of a few Angstroms. The space between the electrodes within the sealing gasket 14 is filled with a suitable electrolyte, as indicated at 20. The electrolyte may be a silver halide dissolved in an organic solvent, such as described in the above article. A mixture of dimethyl sulfoxide, silver halide,, alkali metal halide, and iodine has been found effective. Since the optical properties of the cell are of no consequence, the light absorption characteristics of the electrolyte and the dielectric substrates is not significant.

Electrical connections are made to the metallic electrodes 16 and 18 by a connector 22 made from a nonconductive or dielectric plate 24 having metallic surface layers 26 and 28 which are in electrical contact with the surfaces of the electrodes 16 and 18 in a region outside of the electrolyte region 20. Suitable electrical contacts 30 and 32 can be used to connect the cell to an external voltage source, such as a reversible polarity pulse generator 36. A voltage plus, for example, of the order of 1 volt causes silver to plate out on the surface of one or the other of the electrodes, depending on the polarity of the pulse. Depending on the duration of the pulse, a layer of silver of varying thickness is deposited out on the electrode, causing a sharp drop in the surface resistivity of the electrode. By reversing the polarity of the applied pulse, the plating process can be reversed, causing the metal ions to go back into solution. If the duration of the reversed polarity pulse is extended, the silver ions can be caused to plate out on the other electrode of the cell. Thus the cell provides a variable resistance voltage controlled element which can be utilized as an electrical switch, a variable resistance or impedance, and/or a modulator.

Figure 3:
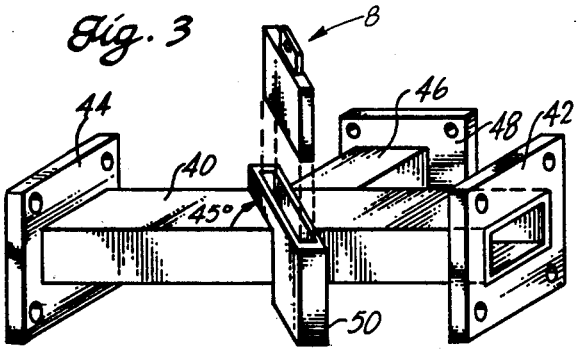
FIG. 3 is a perspective view of a microwave switching device.

For example, the cell 8 can be used as a microwave switch in the manner shown in FIG. 3. The switch includes a main waveguide section 40 having flanges 42 and 44 at either end for connecting the waveguide section into a microwave transmission line, for example. A branching waveguide section 46 terminating in a flange 48 forms a T-junction. The waveguide 40 is formed with a slotted holder 50 extending diagonally at the junction with the cell positioned in the slot. By depositing silver on one of the electrodes of the cell to a thickness greater than the "skin" depth of an impinging electromagnetic wave transmitted by the waveguide, the energy transmitted down the waveguide 40 can be directed to the T-guide 46. If the T-guide 46 is perpendicular to the waveguide 40, the angle of the cell 8 is 45° to the intersecting axes of the waveguides.

When the silver ions are suspended in the solution and are not deposited on either of the electrodes, the transmission of an electromagnetic wave through the waveguide 40 from flange 42 to flange 44 is largely unimpeded. This is so because the reversible electrodeposition switching device consisting of low loss substrates (at the operating wavelength), low loss electrodes (much thinner than the skin depth) and a low loss electrolyte (silver ions suspended in a largely dielectric solution) represents an overall low loss impedance to the impinging electromagnetic wave at the selected operating wavelength. When the silver ions are plated on one or the other of the electrodes, say the one closest to flange 42 in this case, to a thickness greater than the skin depth, an electromagnetic wave entering at flange 42 will be largely redirected to flange 48 via waveguide 46.

If one or the other or both of the electrodes are only partially plated to a depth less than the skin depth, the impinging electromagnetic wave will be partially transmitted and partially reflected such that a division between the waveguide branches occurs dependent on the thickness of the plating.

Figure 4:
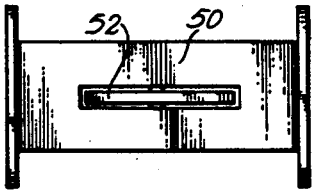
FIG. 4 is a top view of an alternative microwave switch.

Because the cell can be changed from acting primarily as a dielectric to acting primarily as a conductor as the silver is plated out of the solution onto the surface of the dielectric, it will be appreciated that electrodes can be used in waveguides in a plurality of configurations to provide a variable microwave impedance device, FIGS. 3 and 4 being representative of two possible microwave configurations.

A switch or variable attenuator can also be provided, as shown in FIG. 4, by providing a section of rectangular waveguide, indicated at 50, with a slotted opening extending lengthwise in the center of the waveguide. A cell 52 is inserted in the slot and bridges the space between the opposing walls of the rectangular waveguide. By varying the amount of plating on the electrodes of the cell, the amount of resistance and reactance to the microwave energy transmitted through the waveguide can be varied. While a rectangular waveguide is shown by way of example, other shapes of waveguides, such as a circular waveguide, may be used.

Figure 5:
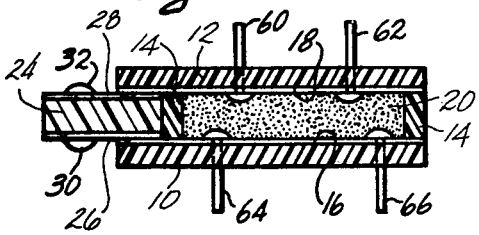
FIG. 5 is a cross-sectional view of a dc or low frequency ac switch.

The electrodeposition cell can also be used for switching low frequency or dc signals. Such a switching arrangement is shown in FIG. 5, which utilizes a cell of the type described above in connection with FIGS. 1 and 2 but with added spaced terminals 60 and 62 extending into the cell and in contact with the electrode 18. An additional pair of terminals 64 and 66 may be provided which are in contact with the surface of the electrode 16. By applying a pulse of a particular polarity across the terminals 30 and 32, silver is caused to plate out on one or the other of the electrodes 16 and 18, depending on the polarity of the applied pulse. The plated silver provides a very low resistance current path bridging the pair of terminals 60 and 62 or terminals 64 and 66. Thus the device of FIG. 5 provides a pair of switches which can either both be open or one or the other closed. Since the thickness of the deposited silver layer is dependent on the magnitude and duration of the electrical pulse, the resistance of the current path between the terminals can be varied from a very high value to a very low value. One of the advantages of the present invention is that the switch can remain closed after the initial pulse is removed. Thus the device operates as a latching device or relay in that a relatively low energy control pulse produces a low resistance path for controlling a larger amount of electrical energy. Since the resistivity can be varied to a degree, the device also acts as a variable conductance device similar in nature to a vacuum tube or a transistor. While the switching or modulation rate of the device is relatively slow due to the nature of the plating action, the device itself can be used to switch signals having a wide frequency range.

Figure 6:
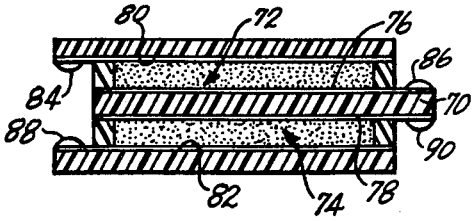
FIG. 6 is a cross-sectional view of a variable capacitance device.

The electrodeposition cell can also be modified to provide a variable capacitance, where Q is defined as the ratio of reactance to resistance. Referring to FIG. 6, a variable Q capacitance device is shown which, in effect, comprises two electrodeposition cells with a common substrate 70 being common to the two cells, one of which is indicated generally at 72 and the other at 74. Each of the cells is constructed as described above in connection with FIGS. 1 and 2. The common substrate 70 forms the dielectric of a capacitor, the plates of which form the electrodes 76 and 78 of the two cells. Initially, the electrodes (and plates of the capacitor) have a high series resistance due to the fact they are a very thin molecular metallic layer and hence the Q of the capacitor is relatively low. By applying a potential between the back electrodes 80 and 82 with respect to the electrodes 76 and 78, silver is caused to plate out on the electrodes 76 and 78 to form low resistance plates of the capacitor formed with the dielectric 70. A pulse of electrical energy of the right polarity and magnitude between terminals 84 and 86 or 88 and 90 will cause an electrodeposition of metal of fixed, stepped or variable extent on the surfaces 76 and 78, respectively.

Figure 7:
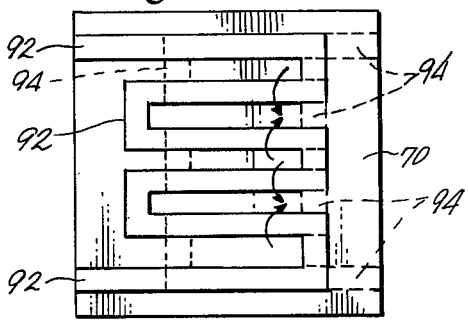
FIG. 7 is a plan view of the device used as a variable Q inductance or as a variable impedance transformer.

The same basic device as shown in FIG. 6 can be used as a variable Q inductance or as a variable impedance transformer by controlling the shape of the electrodes and hence the shape in which electrodeposition of silver takes place. Thus, as shown in FIG. 7, the common substrate 70 of the cell shown in FIG. 6 is provided with metal electrodes 76 and 78 on opposite surfaces that have a serpentine shape, as indicated at 92 and 94. There is mutual inductance between the aligned sections of the two serpentine conductive electrodes, as indicated by the arrows. When pulses are applied, silver is plated on the serpentine electrodes 92 and 94, reducing their resistance yet are dc isolated from each other by the dielectric 70 between them. Thus the device forms a variable Q choke, transformer, or an inductive tuning device.

From the above description, it will be seen that a reversible electrodeposition element is provided which has unique electrical properties enabling it to be used as a switching device for electrical signals over a broad frequency band including dc. It can also be used as a digital logic element. Once switched, the device remains switched for a relatively long period of time (minutes). Obviously, a "refreshing" pulse may be used periodically to maintain the plating indefinitely. Thus the energy required to control the device is quite small. While the switching or modulation speed of the device is slow compared to transistors, for example, its characteristics nevertheless provide obvious advantages in certain situations.

What is claimed is:

1. An electrical switching device comprising:

a pair of spaced dielectric substrates, a high resistance molecular metallic layer on one surface of each of the dielectric substrates, means holding the substrates with the metallic layers in spaced relationship adjacent each other, an electrolytic solution having metal ions in the space between the adjacent metallic layers, a pair of terminals contacting one of said metallic layers at separate points that are spaced from each other, and means for applying a voltage pulse of a first polarity across the electrodes to cause electrodeposition of the metal ions in the electrolyte on said one of the metallic layers, the electrodeposited metal substantially reducing the electrical resistance between said terminals.

2. Apparatus of claim 1 further including means for applying a voltage pulse across the electrodes of reverse polarity to cause the metal to go back into solution in the electrolyte.

3. Apparatus of claim 1 further including a second pair of terminals contacting the other of said metallic layers, said means applying a voltage pulse of reverse polarity providing a pulse of sufficient duration to electrodeposit metal on said other metallic layer between the second pair of terminals.

4. Apparatus of claim 1 wherein the metallic ions are silver.

5. A microwave device comprising:

a waveguide section for conducting microwave energy, a control device including a pair of spaced dielectric substrates and a high resistance molecular metallic layer on each dielectric substrate, the layers having a thickness that is substantially transparent to any microwave energy transmitted by the waveguide section, means holding the substrates with the metallic layers in spaced relationship adjacent to each other, an electrolytic solution having metal ions in the space between the adjacent metallic layers, and means for applying a voltage pulse of a first polarity across the electrodes to cause electrodeposition of the metal ions in the electrolyte on said one of the metallic layers to a thickness that reflects a substantial portion of the microwave energy transmitted by the waveguide section.

6. The microwave device of claim 5 wherein said metallic layers extend parallel to the longitudinal axis of the waveguide.

7. The microwave device of claim 6 further including:

a branch waveguide section forming a T-junction with the first-named waveguide section, said metallic layers being extended diagonally to and positioned at the intersecting axes of the waveguide sections of the T-junction whereby microwave energy reflected by the metallic layers is directed into the branch waveguide.

8. A variable impedance device comprising:

first and second dielectric substrates, a high resistance molecular metallic layer deposited on at least one side of the substrates forming first and second electrodes, the electrodes being adjacent each other, an electrolytic fluid containing metal ions in solution filling the space between the electrodes, means for applying an electrical potential between the electrodes for causing the metal ions to deposit out of solution onto the first of said electrodes, means forming a conductive surface on the opposite side of said first substrate, and terminal means electrically connected to the first electrode and the conductive surface on the two sides of the first substrate.

9. Apparatus of claim 8 further including a third substrate adjacent said opposite side of the first substrate from the second substrate, the adjacent surfaces of the first and third substrates each having a high resistance molecular metallic layer deposited thereon forming electrodes, an electrolyte fluid between the first and third substrates, the fluid containing metal ions in solution, means applying a potential between the adjacent surfaces of the first and third substances for causing the metal ions to deposit on the surface of the first substrate to form said conductive surface.

10. Apparatus of claim 9 wherein the high resistance molecular layers on the opposite sides of the first substrate have an elongated serpentine shape with substantial portions of the respective serpentine shaped layers being aligned with each other, and terminal means for providing electrical connections to opposite ends of both serpentine shaped layers.

11. A variable impedance device comprising:

first and second dielectric substrates, a high resistance molecular metallic layer deposited on at least one side of both substrates forming first and second electrodes, an electrolytic fluid containing metal ions in solution filling the space between the electrodes, means for applying an electrical potential between the electrodes for causing the metal ions to deposit out of solution onto the first electrode, and a pair of spaced terminals contacting the metallic layer of the first electrode.

* * * * *